US011441741B2

(12) United States Patent
Matus, Jr.

(10) Patent No.: US 11,441,741 B2
(45) Date of Patent: Sep. 13, 2022

(54) SYSTEM AND METHOD FOR LED LIGHT KIT RETROFIT TO A FOOD SHIELD

(71) Applicant: Jose Orlando Matus, Jr., Gainesville, GA (US)

(72) Inventor: Jose Orlando Matus, Jr., Gainesville, GA (US)

( * ) Notice: Subject to any disclaimer, the term of this patent is extended or adjusted under 35 U.S.C. 154(b) by 0 days.

(21) Appl. No.: 17/519,226

(22) Filed: Nov. 4, 2021

(65) Prior Publication Data

US 2022/0136661 A1 May 5, 2022

Related U.S. Application Data

(60) Provisional application No. 63/109,735, filed on Nov. 4, 2020.

(51) Int. Cl.

| | |
|---|---|
| ***F21K 9/237*** | (2016.01) |
| ***F21K 9/235*** | (2016.01) |
| *F21Y 115/10* | (2016.01) |

(52) U.S. Cl.

CPC ..... *F21K 9/237* (2016.08); *F21K 9/235* (2016.08); *F21Y 2115/10* (2016.08)

(58) Field of Classification Search

CPC ..... F21K 9/237; F21K 9/235; F21Y 2115/10

See application file for complete search history.

(56) References Cited

U.S. PATENT DOCUMENTS

2010/0328852 A1* 12/2010 Johnson ..... H02G 3/00 439/345
2014/0268716 A1* 9/2014 Yu ..... F21V 15/013 362/217.12
2018/0306971 A1* 10/2018 Conrad ..... F21K 9/61
2021/0341134 A1* 11/2021 May ..... F21S 8/046

FOREIGN PATENT DOCUMENTS

CN 211780350 U * 10/2020

OTHER PUBLICATIONS

English translation of Tan CN-211780350-U, published Oct. 2020 (Year: 2020).*

* cited by examiner

*Primary Examiner* — Evan P Dzierzynski
(74) *Attorney, Agent, or Firm* — Smith Tempel Blaha LLC; Matthew T. Hoots

(57) ABSTRACT

Exemplary embodiments of a system for retrofit of an LED light kit to a food shield system are disclosed. Certain embodiments are configured such that an existing food shield system may be retrofitted with an LED light strip without having to deconstruct the food shield system. Depending on embodiment, the solution allows for the LED light kit to be mounted to a panel surface or along the edge of a panel. Advantageously, a power supply wire may be received into the system in such a way that it is secured and unable to be inadvertently disconnected from the LED light strip. It is a further advantage of certain embodiments of the solution that they may be installed without creating any undesirable gap or crevice that would harbor pathogens or be difficult to clean.

17 Claims, 16 Drawing Sheets

SYSTEM AND METHOD FOR LED LIGHT KIT RETROFIT TO A FOOD SHIELD

CROSS-REFERENCE TO RELATED APPLICATIONS

The present application claims the benefit of the filing date of the U.S. Provisional Application Ser. No. 63/109,735 filed on Nov. 4, 2020, the entire contents of which are hereby incorporated by reference.

BACKGROUND

The present invention relates to systems and methods for food shield systems (sometimes called "sneeze guards" or "food guards") and, more particularly, to a light kit system for retrofit of an LED light strip to a food shield.

The spread of viruses and other pathogens into and among the general public is a constant concern of the food service industry, particularly in cafeteria style and buffet style serving applications. Consequently, there is an almost ubiquitous use of food shield systems in locations where food is on public display for consumer consumption, such as cafeterias, restaurants, convenience stores, and grocery stores. A food shield provides a barrier between the consumer's mouth and the food and is typically a system comprising transparent tempered glass or plastic panels attached to supporting posts or framework. A food shield system is intended to shield the food beneath/behind it from airborne bacteria, contaminants, breath, sneezes or coughs expelled by the consumer, while allowing the consumer to view the food on display.

There are typically three types of food shield systems, depending on how the food is displayed and/or served: (a) a "self-service" type, (b) an "attendant-served" type, and (c) a "vertical partition" type. A "self-service" food shield system will allow a consumer direct access to the food beneath/behind the food shield such that the consumer may serve himself. An "attendant-served" food shield system allows a consumer to view the food that is beneath/behind the food shield but does not provide the consumer with direct access to the food (an attendant working behind the attendant-served food shield system plates the food and passes it over or around the food shield to the consumer). And, a vertical partition food shield system, such as might be used at a wok or grill, allows a consumer to view the food that is being prepared behind the food shield but does not provide the consumer with direct access to the food or an attendant any way to pass the food to the consumer over the system (in a vertical partition system, the prepared food is generally "passed down the line" by attendants and provided to the consumer at a point of sale).

All food shield systems include at least a main viewing panel positioned to optimally protect the food from exposure, usually made of glass or clear plastic so that users can view the food without breathing, sneezing, or coughing on it. Commonly, food shield systems also include top panels or other panels similarly constructed from glass or clear plastic.

While some food shield systems may incorporate a lighting system to better view food displayed beneath the system, many do not. And so, there is a need in the art for a system that can be used to retrofit an LED light strip to an existing, already installed food shield system.

SUMMARY

Exemplary embodiments of a system for retrofit of an LED light kit to a food shield system are disclosed. An example of an LED light kit can be seen at www.leding-edge.com. Certain embodiments are configured such that an existing food shield system may be retrofitted with an LED light strip without having to deconstruct the food shield system. Depending on embodiment, the solution allows for the LED light kit to be mounted to a panel surface or along the edge of a panel. Advantageously, a power supply wire may be received into the system in such a way that it is secured and unable to be inadvertently disconnected from the LED light strip. It is a further advantage of certain embodiments of the solution that they may be installed without creating any undesirable gap or crevice that would harbor pathogens or be difficult to clean.

An exemplary system for retrofit of an LED light kit to a food shield system includes an LED light strip, a wiring end block assembly, a blind end block assembly, and one or more center support assemblies. The wiring end block assembly comprises an upper portion and a lower portion that are separable, one from the other, and mechanically mated by one or more fasteners. The upper portion and lower portion of the wiring end block assembly, when mated, cooperate to define an internal cavity of the wiring end block assembly, the internal cavity being configured to receive a plug head associated with power supply wiring through a first aperture and a power connection head associated with the LED light strip through a second aperture. In this way, the power connection head may be "plugged into" the plug head of the power supply wiring, thereby energizing the LED light strip and protecting the electrical junction within the cavity of the wiring end block assembly. Advantageously, the internal cavity of the wiring end block assembly comprises one or more shoulders configured to seat against the plug head associated with power supply wiring such that the plug head is prevented from being retracted through the first aperture.

Similarly, the blind end block assembly comprises an upper portion and a lower portion that are separable, one from the other, and mechanically mated by one or more fasteners. The upper and lower portions of the blind end block assembly, when mated, cooperate to define an internal cavity of the blind end block assembly, the internal cavity being configured to receive an end head associated with the LED light strip through a first aperture. In this way, the end head associated with the LED light strip is protected within the blind end block assembly cavity.

Also similarly, each of the one or more center support blocks comprise an upper portion and a lower portion that are separable, one from the other, and mechanically mated by one or more fasteners. The upper and lower portions of a center support block define an internal cavity of the center support block through which the LED light strip may be inserted or translated.

Each of the wiring end block assembly and the blind end block assembly include a separable mounting block operable to mechanically mate the system to a food shield panel. The separable mounting blocks may be modularly attached to the assemblies via one or more fasteners, such as screws. The separable mounting blocks may comprise a threaded screw or a hook feature. For those mounting blocks that comprise a threaded screw, the system may be mounted to the surface of a food shield panel through drilled holes in the panel. For those mounting blocks that comprise a hook feature, the system may be mounted along the edge of a food shield panel by "hanging" the system along the edge of the panel using the hook features. Similarly, the upper portion of a center support block may include either a threaded screw or hook feature, depending on embodiment. Wiring end block assemblies, blind end block assemblies, and/or center support blocks including hook features further include set screws for securing the food shield panel within the hook.

The wiring end block assembly may also be configured to mechanically mate with a wiring conduit. The wiring conduit may be placed over a bored hole in a counter, such as a food service counter over which there is a food shield system, in order to provide a mechanism by which power supply wiring may be directed to the wiring end block assembly. A counter collar may be slidably mounted over/on the conduit such that it may be positioned over the counter hole. Any one or more of the wiring end block assembly, blind end block assembly and center support block may be manufactured or constructed from aluminum, stainless steel, plastic, or any material suitable for food service applications.

BRIEF DESCRIPTION OF THE DRAWINGS

In the drawings, like reference numerals refer to like parts throughout the various views unless otherwise indicated. For reference numerals with letter character designations such as "100A" or "100B", the letter character designations may differentiate two like parts or elements present in the same figure. Letter character designations for reference numerals may be omitted when it is intended that a reference numeral to encompass all parts having the same reference numeral in all figures.

DETAILED DESCRIPTION

Various embodiments, aspects and features of the present invention encompass a system for retrofit of an LED light kit to a food shield.

In this description, the terms "food shield," "food shield system," "food guard," "food guard system," "sneeze guard" and the like are used interchangeably and refer to any system configured to present a barrier between the general public or consumers and food, drinks or other items staged on a serving table, bar, or buffet.

Figure 1A:
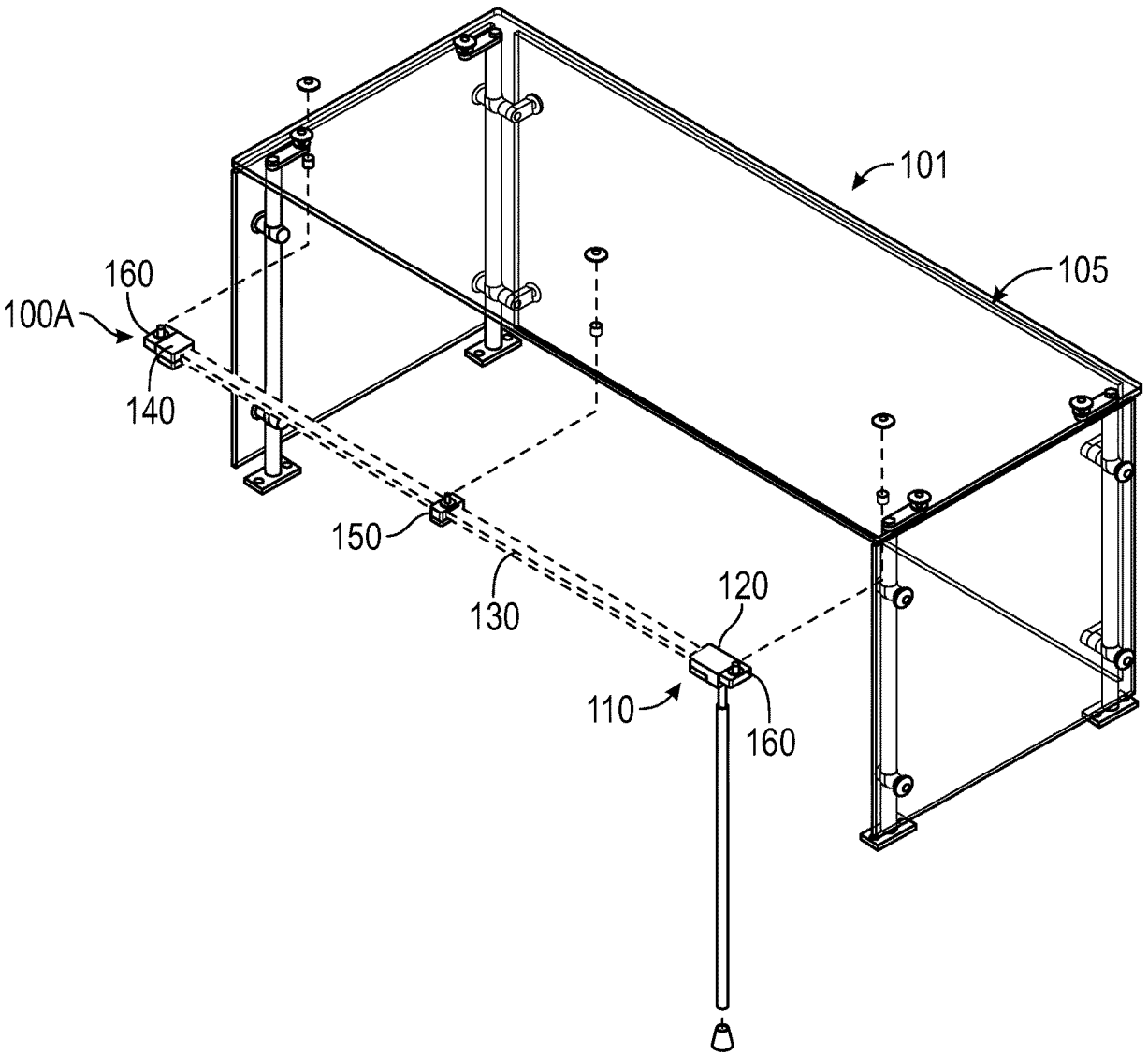
FIGS. 1A and 1B illustrate exemplary embodiments according to the solution for a system for retrofit of an LED light kit to a food shield system, the FIG. 1A embodiment configured for panel surface mounting and the FIG. 1B embodiment configured for panel edge mounting.
Figure 1B:
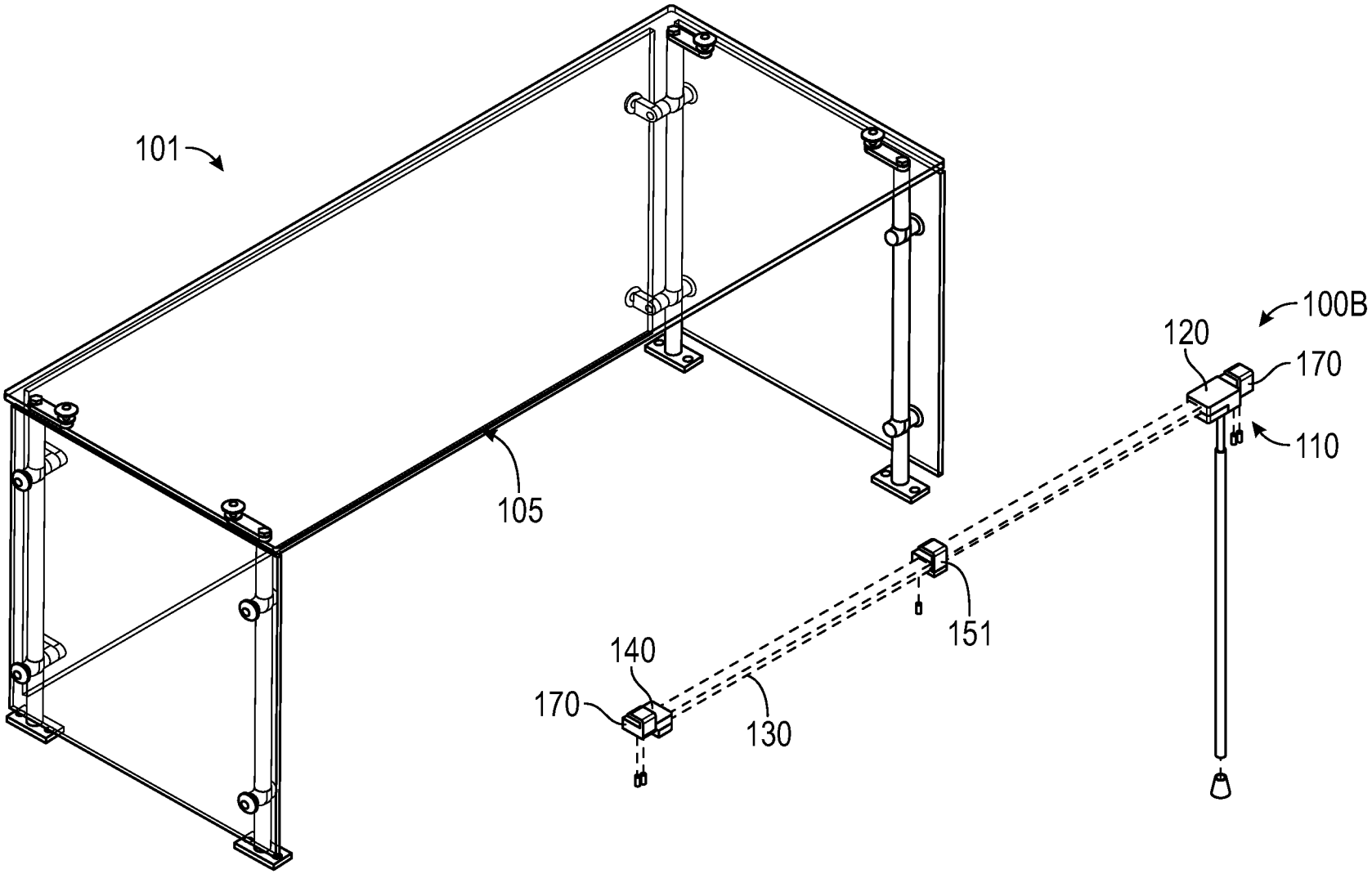

Referring to FIGS. 1A and 1B, illustrated are exemplary embodiments of a system 100 for retrofit of an LED light kit to a food shield system, according to the solution. The FIG. 1A embodiment 100A is configured for panel surface mounting and the FIG. 1B embodiment 100B is configured for panel edge mounting. Both embodiments 100 are illustrated as mounted to an attendant-served type food shield system 101, although one of ordinary skill in the art would recognize that application of the embodiments are not limited to attendant-served type food shield systems.

The FIGS. 1A and 1B embodiments are essentially the same, with the exception that the exemplary embodiment 100A shown in FIG. 1A is configured to be mounted underneath a glass panel 105 (such as a top panel) of a food shield system while the exemplary embodiment 100B shown in FIG. 1B is configured to be mounted along the edge of a glass panel 105. Notably, although embodiments of the solution are described herein as being mounted to glass panels that form a part of a food shield system, it will be understood that a retrofit LED light kit for food shield systems according to the solution is not limited to application on shelves made of glass.

For both embodiments, it can be understood from the illustrations that a power end 110 of the system 100 in the form of a universal wiring end block assembly 120 is configured to receive electrical wiring and electrically connect the wiring to an LED light strip 130 (more detail regarding the universal wiring end block assembly 120 will be shown and described in subsequent figures). The light strip 130 extends from the universal wiring end block assembly 120 to a blind end block assembly 140 (more detail regarding the universal blind end block assembly 140 will be shown and described in subsequent figures). A center support assembly 150, 151 may be located at a point along the LED light strip 130 (more detail regarding the center support assemblies 150, 151 will be shown and described in subsequent figures).

The universal wiring end block assembly 120, center support assemblies 150, 151, and universal blind end block assembly 140 may all be configured for mounting to a panel of the food shield, such as panel 105. In the FIG. 1A embodiment, each of the universal wiring end block assembly 120 and universal blind end block assembly 140 are shown mated with a panel surface mounting block 160 configured for panel surface mounting applications using threaded screws. Similarly, the center support assembly 150 comprises a threaded screw mounting feature. As can be understood from the illustrations, a system for retrofit of an LED light kit to a food shield 100A that leverages threaded screw mounting blocks 160 and center support assembly 150 (if needed) may be mounted to a panel, such as panel 105, by insertion of mounting screws through drilled hole(s) in the panel. Advantageously, the position of the system 100A on the panel 105 may be customized according to user preference, as the placement of the drilled holes dictate the relative position of the system 100A.

In the FIG. 1B embodiment, however, each of the universal wiring end block assembly 120, and universal blind end block assembly 140 are shown mated with a panel edge mounting block 170 that includes a hook feature configured for panel edge mounting applications. Similarly, the center support assembly 151 comprises a hook connection feature. As can be understood from the illustrations, a system for retrofit of an LED light kit to a food shield 100B that leverages panel edge mounting blocks 170 and center support assembly 151 (if needed) may be mounted to a panel, such as panel 105, by receiving the edge of a panel into the hook features of the panel edge mounting blocks 170 and center support assembly 151 such that the system 100B may be "hung" off the panel edge. A means for tightening the hook feature(s) snugly to a panel edge, such as via a setscrew, is envisioned and will be shown and described in more detail in subsequent figures. As will become better understood from a full review of the disclosure, it is an advantage of certain embodiments of the solution that the universal wiring end block assembly 120 and/or universal blind end block assembly 140 are configured to be modular with threaded screw mounting blocks 160 and panel edge mounting blocks 170. In this way, a user of the system 100 may be able to select mounting hardware 160, 170 according to the mounting application at hand without having to acquire all new hardware for the wiring end block assembly and blind end block assembly. This modular design of certain embodiments of the system 100 is also an advantage to a manufacturer or supplier of the system 100 as a reduced amount of hardware is necessary for manufacture or inventory in order to accommodate various mounting applications.

Figure 2A:
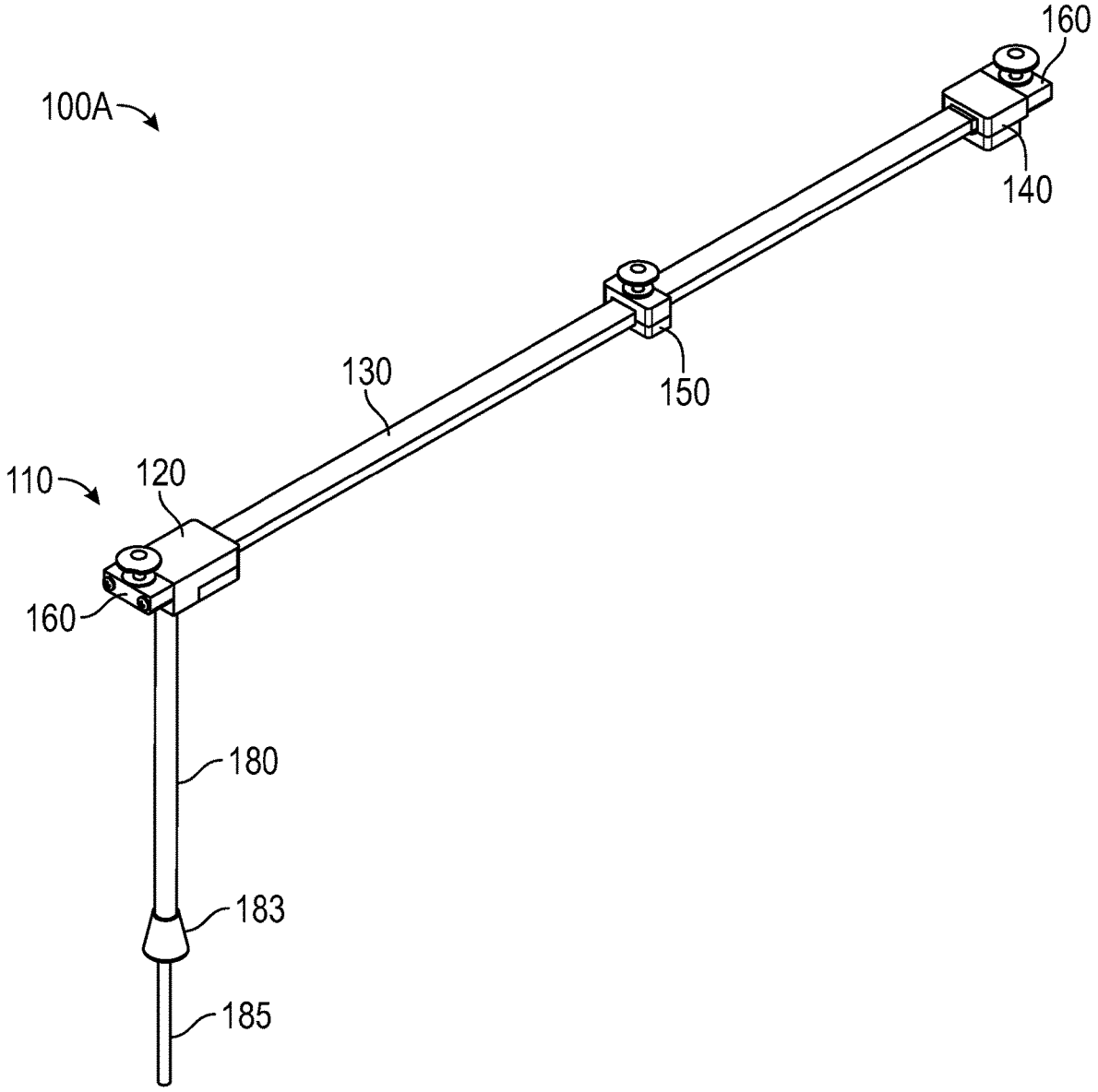
FIGS. 2A and 2B illustrate isolated views of the exemplary embodiments shown in the FIG. 1A and FIG. 1B illustrations, respectively.
Figure 2B:
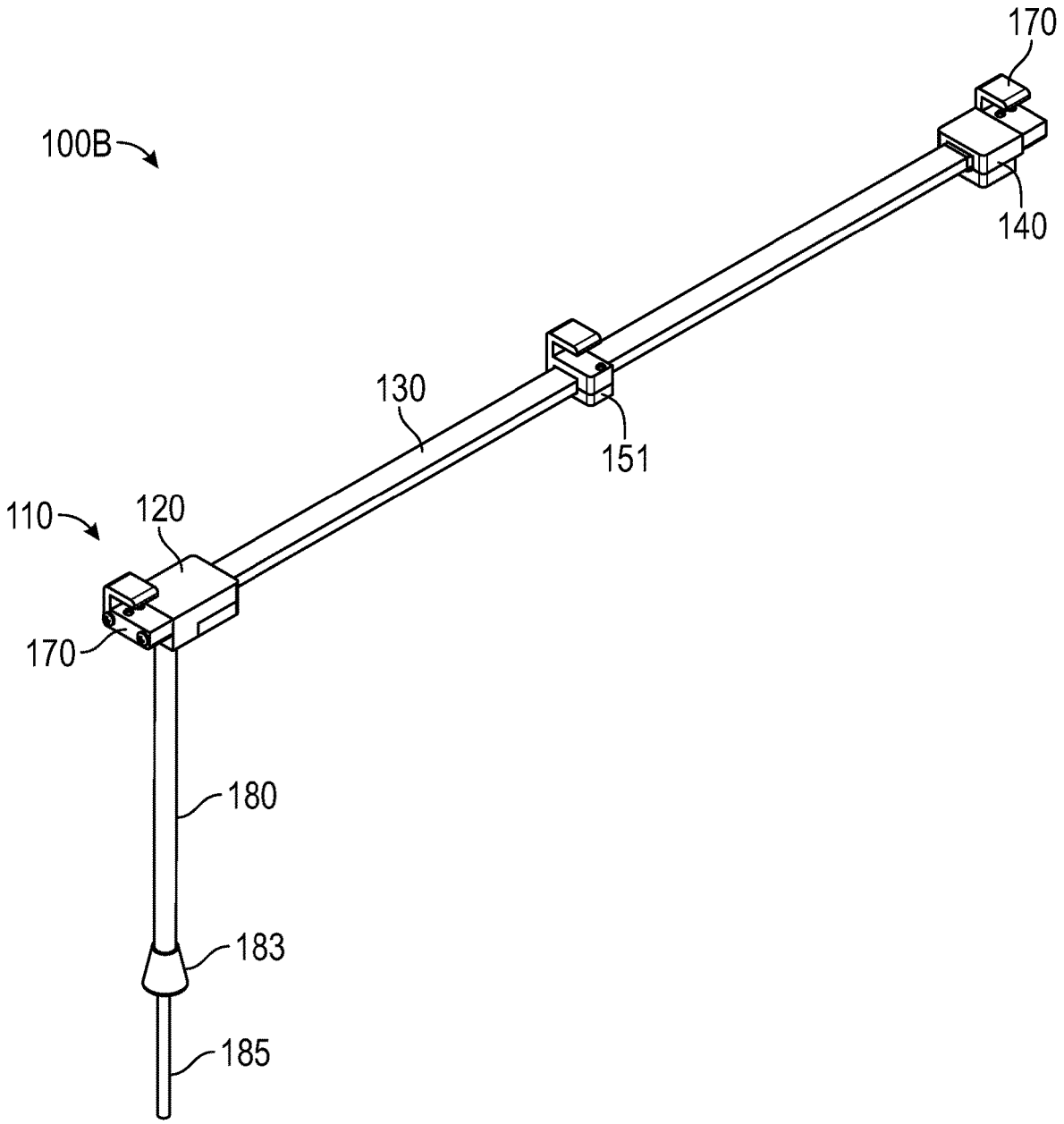

FIGS. 2A and 2B illustrate isolated views of the exemplary embodiments 100A, 100B shown in the FIG. 1A and FIG. 1B illustrations, respectively. As can be better seen in the FIG. 2A and FIG. 2B illustrations, the power end of the system 100 receives an electrical wire power supply 185 into the universal wiring end block assembly 120 through a conduit 180. In certain embodiments, the universal wiring end block assembly 120 may be configured to mechanically receive/mate with the conduit 180 in order to provide a clean fit and finish. Additionally, the conduit 180 may be fitted with a collar 183 sized and configured to interface with a hole in a counter surface through which the electrical wire power supply is pulled. Advantageously, and as will become better understood from subsequent drawings and description, the "cut to length" feature of the conduit 180 coupled with the collar 183 enables a clean retrofit installation of the system 100 to an existing food shield application.

The system 100A of the FIG. 2A illustration demonstrates threaded screw mounting blocks 160 mechanically received onto the ends of both universal wiring end block assembly 120 and the universal blind end block assembly 140. A threaded screw mounting feature is also shown in association with center support assembly 150. Similarly, the system 100B of the FIG. 2B illustration demonstrates panel edge mounting blocks 170 with hook features mechanically received onto the ends of both universal wiring end block assembly 120 and the universal blind end block assembly 140. And, a hook connection feature is also shown in association with center support assembly 151. Notably, although the system 100A embodiment is illustrated with threaded screw mounting blocks 160 and the system 100B embodiment is illustrated with the panel edge mounting blocks 170, it is envisioned that an advantage of the system 100 is that at the preference of a user either of a panel surface mounting block 160 or a panel edge mounting block 170 may be mechanically mounted in association with each of universal wiring end block assembly 120 and universal blind end block assembly 140. In this way, the modularity of the system 100 provides maximum flexibility in application while minimizing the number of components required to maintain in inventory.

The LED light strip 130 may be electrically connected to, and energized by, the electrical power supply 185 within the universal wiring end block assembly 120. The LED light strip 130 extends to blind end block assembly 140 where it is electrically terminated, as would be understood by one of ordinary skill in the art of LED light strips. If the length of LED light strip 130 warrants, the LED light strip 130 may be extended through, and supported by, one or more of center support assemblies 150 (see FIG. 2A) or 151 (see FIG. 2B). The lengths of LED light strip 130 that are exposed between the components 120, 140, 150/151, when energized, may emit light useful for illuminating food or other items stored beneath the food shield system (such as exemplary food shield system 101).

Figure 3A:
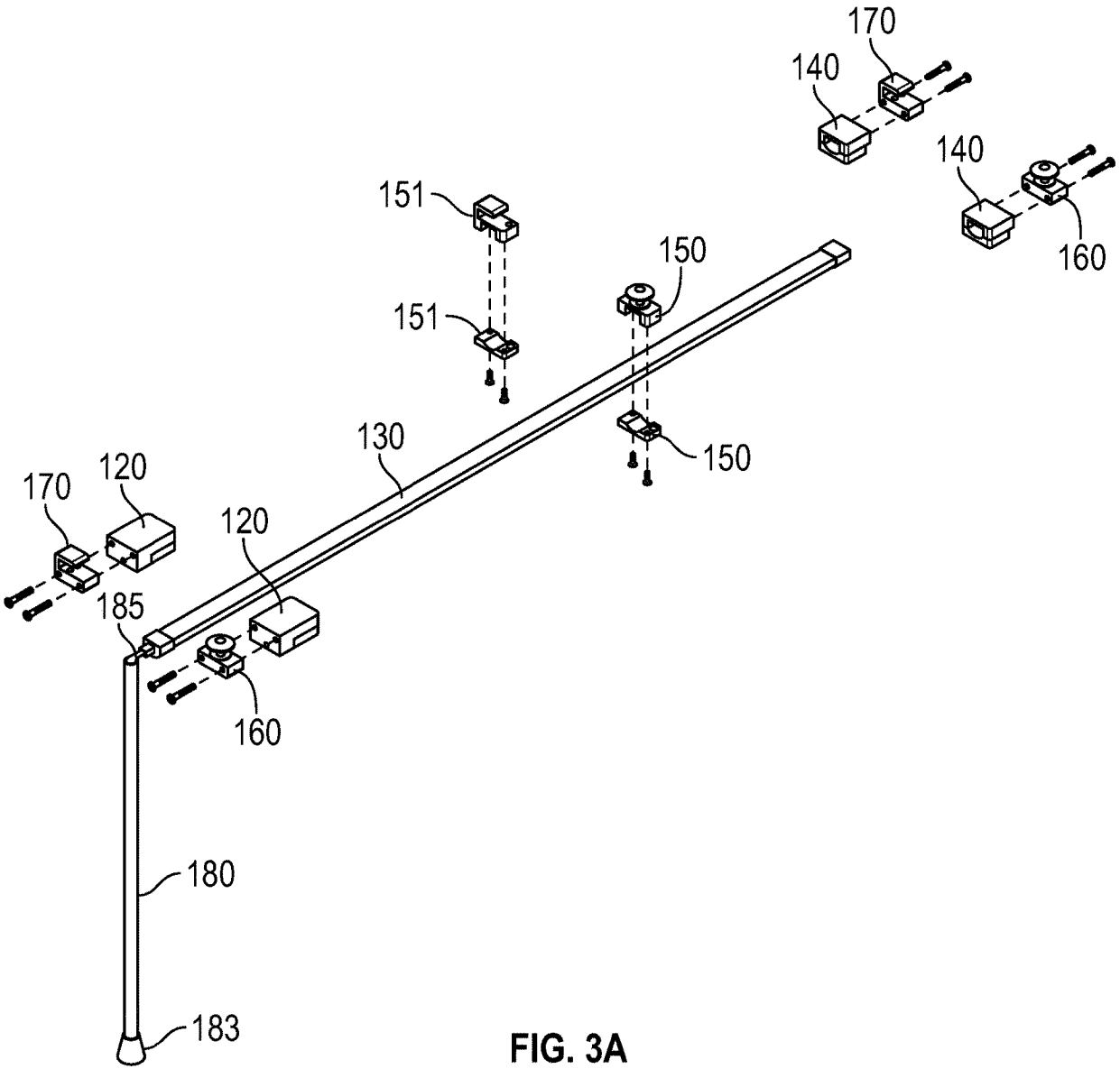
FIG. 3A is a partially exploded view of both of the embodiments shown in FIGS. 1 and 2.
Figure 3B:
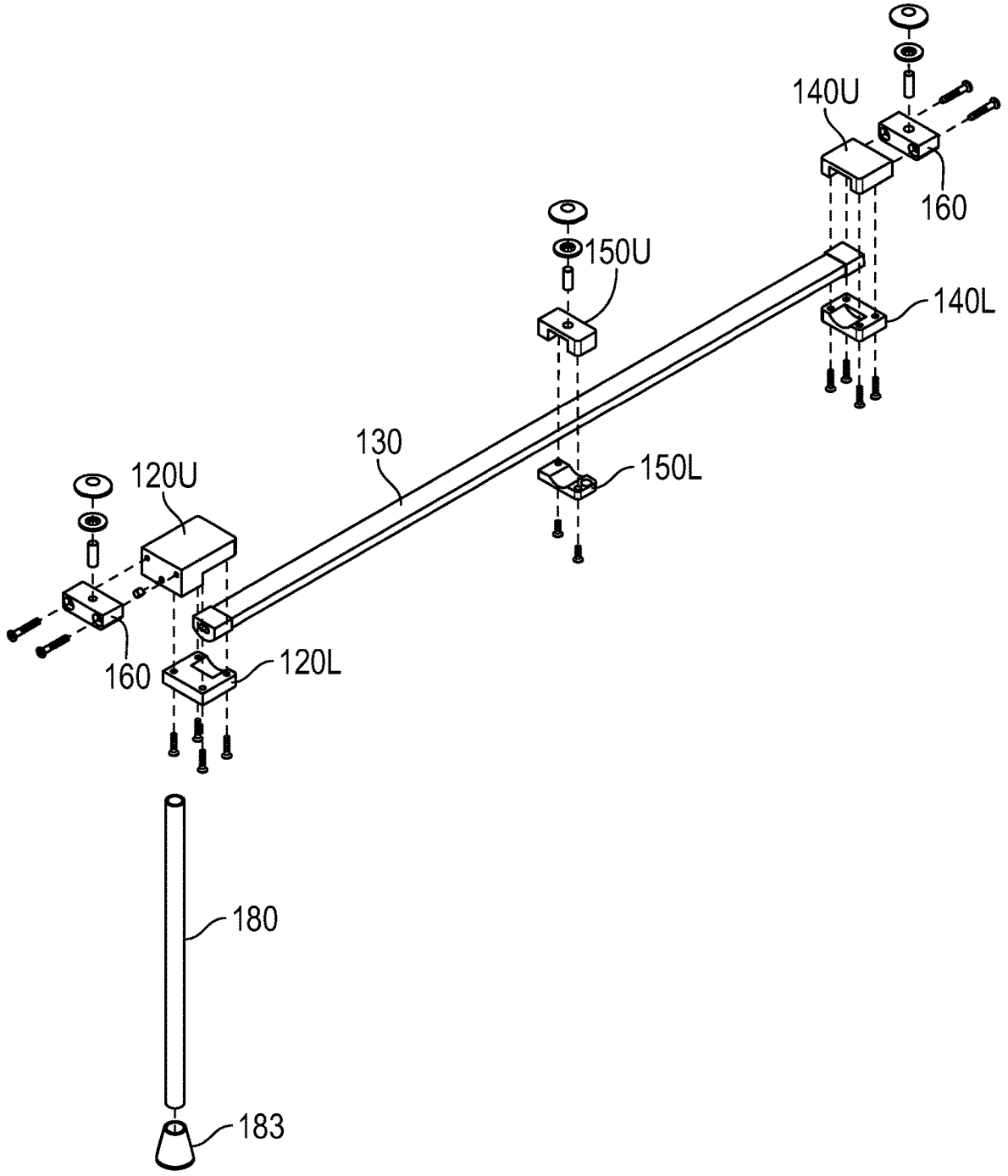
FIG. 3B is a fully exploded view of the embodiment shown in FIGS. 1A and 2A.
Figure 3C:
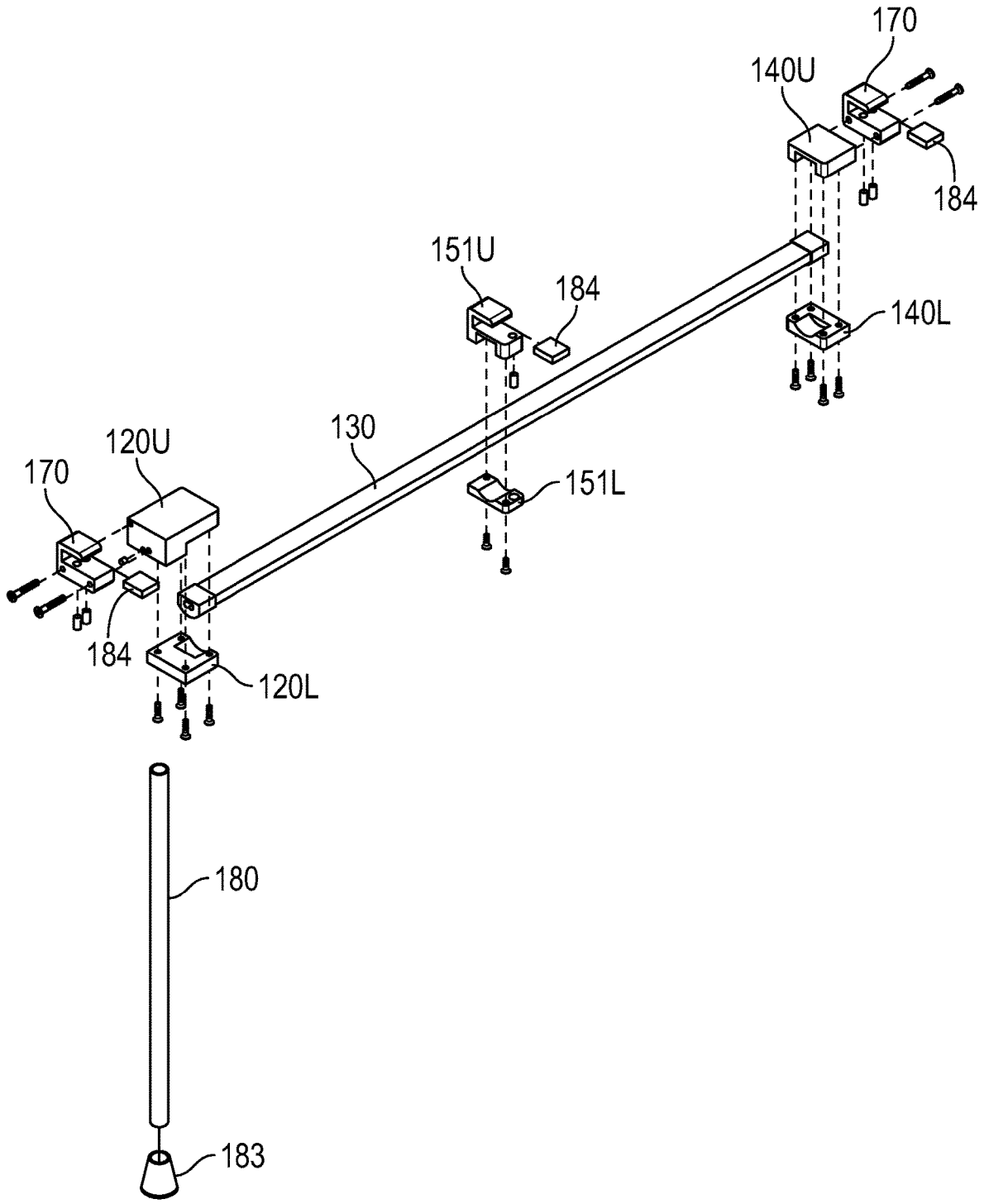
FIG. 3C is a fully exploded view of the embodiment shown in FIGS. 1B and 2B.

Turning now to FIGS. 3A-3C, the illustrations will be described simultaneously. FIG. 3A is a partially exploded view of both of the embodiments shown in FIGS. 1 and 2. FIG. 3B is a fully exploded view of the embodiment shown in FIGS. 1A and 2A. And, FIG. 3C is a fully exploded view of the embodiment shown in FIGS. 1B and 2B. As previously described, the electrical power supply 185 may be pulled from a source through conduit 180. Depending on embodiment, conduit 180 may be "cut-to-length" in the field, as would be understood by one of ordinary skill in the art. The collar 183 may be operable to "slide" up and down the conduit 180 and configured to sit in/over a hole drilled in a serving surface or counter in order to conceal the hole.

Power supply 185 may be connected to LED light strip 130 within universal wiring end block assembly 120. The LED light strip 130 may be extended along the length of a food shield system panel (such as panel 105 in FIGS. 1A and 1B) and terminated at universal blind end block assembly 140. Along the length of LED light strip 130, one or more center support assemblies 150 (threaded screw mounting feature) or 151 (hook connection feature) may be used to support the LED light strip 130. Advantageously, the universal wiring end block assembly 120 and the universal blind end block assembly 140 may be modularly mated to either a panel surface mounting block 160 or a panel edge mounting block 170. Specifically regarding panel edge mounting blocks 170 with a hook connection feature and the hook connection feature of center support assembly 151, a friction pad 184 may be included within the hook feature such that the system 100 is discouraged from slipping off of the end of the food shield panel.

Each of the universal wiring end block assembly 120, universal blind end block assembly 140 and center support assemblies 150/151 may comprise an upper portion 120U, 140U, 150U, 151U, respectively. Further, each of the universal wiring end block assembly 120, universal blind end block assembly 140 and center support assemblies 150/151 may comprise a lower portion 120L, 140L, 150L, 151L, respectively. The upper and lower portions may be mated together such that the LED light strip 130 is "sandwiched" between the upper and lower portions. A panel surface mounting block 160 or a panel edge mounting block 170 may be modularly mounted to the ends of either a universal wiring end block assembly 120 or a universal blind end block assembly 140. More detail regarding the individual components that form exemplary assemblies 120, 140, 150/151 will be shown and described relative to subsequent figures.

Figure 4:
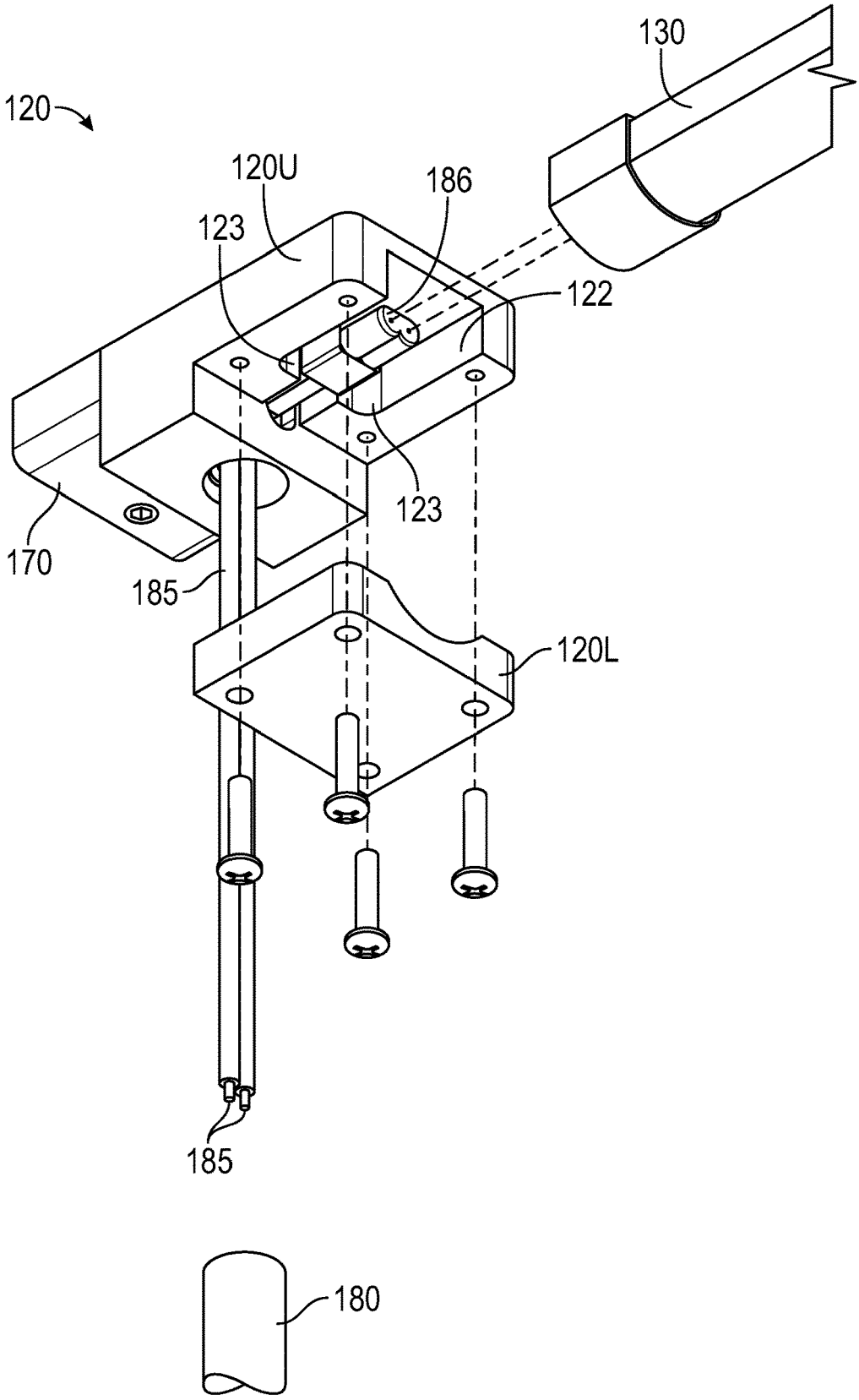
FIG. 4 is a detailed, bottom perspective view of a universal wiring end block assembly included in certain embodiments of the solution, illustrated with a panel edge mounting block attached thereto.

FIG. 4 is a detailed, bottom perspective view of a universal wiring end block assembly 120 included in certain embodiments of the solution, illustrated with a panel edge mounting block 170 attached thereto. As can be understood from the FIG. 4 illustration, the electrical power supply wiring 185 providing power to the LED light strip 130 is received into the wiring end block assembly 120 from the wire guide conduit 180. The electrical wiring may include a pronged connection head or plug 186, as would be understood by one of ordinary skill in the art. The electrical wiring 185 may be threaded through the block 120 such that the connection head 186 is received into a cavity 122 that includes shoulders 123. The cavity 122 is defined when the lower portion 120L and upper portion 120U are mated together. Advantageously, the connection head or plug 186 of the electrical power wire 185 seats against the shoulder 123 such that it cannot be pulled out of the wiring end block assembly 120 once the lower portion 120L block cover is attached to the upper portion 120U to "trap" the plug 186 within the universal wiring end block assembly 120.

Figure 5A:
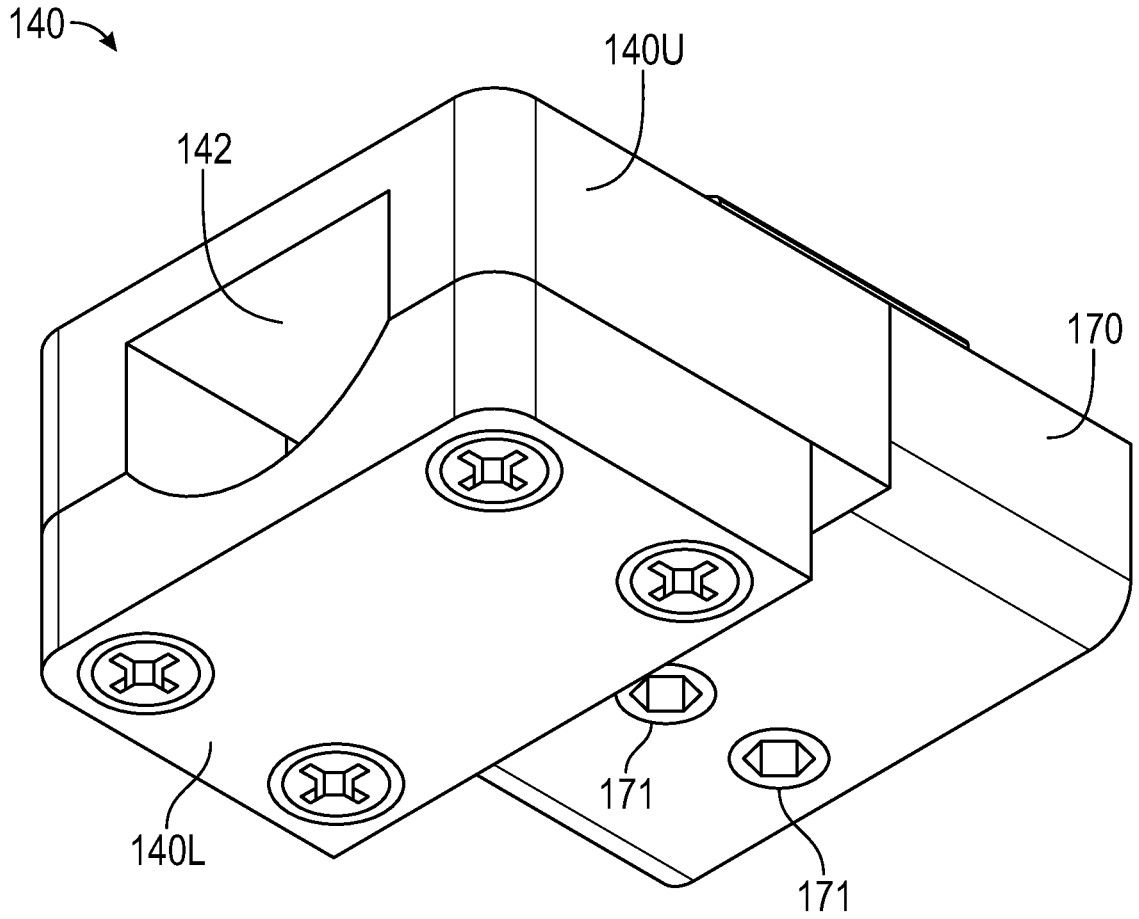
FIG. 5A is a detailed, bottom perspective view of a universal blind end block assembly included in certain embodiments of the solution, illustrated with a panel edge mounting block attached thereto.

FIG. 5A is a detailed, bottom perspective view of a universal blind end block assembly 140 included in certain embodiments of the solution, illustrated with a panel edge mounting block 170 attached thereto. It can be understood from the FIG. 5A illustration that the lower portion 140L mates with the upper portion 140U and is mechanically mated with a series of fasteners. The underside view of the panel edge mounting block 170 illustrates a pair of set screws 171 that may be tightened in order to secure a panel 105 in the hook feature (see previous illustrations). The LED light strip 130 (not shown in the FIG. 5A illustration) may be terminated within a cavity 142 defined by upper and lower portions 140U, 140L.

Figure 5B:
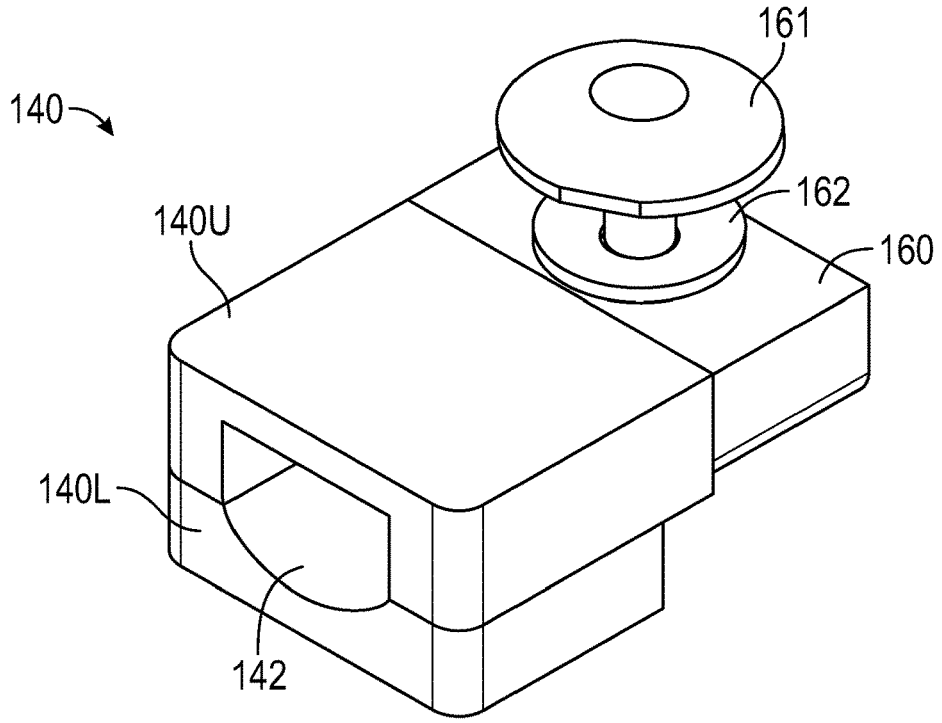
FIGS. 5B and 5C are detailed, top perspective views of the universal blind end block assembly illustrated in FIG. 5A, with FIG. 5B depicted with a panel surface mounting block attached thereto and FIG. 5C depicted with a panel edge mounting block attached thereto.
Figure 5C:
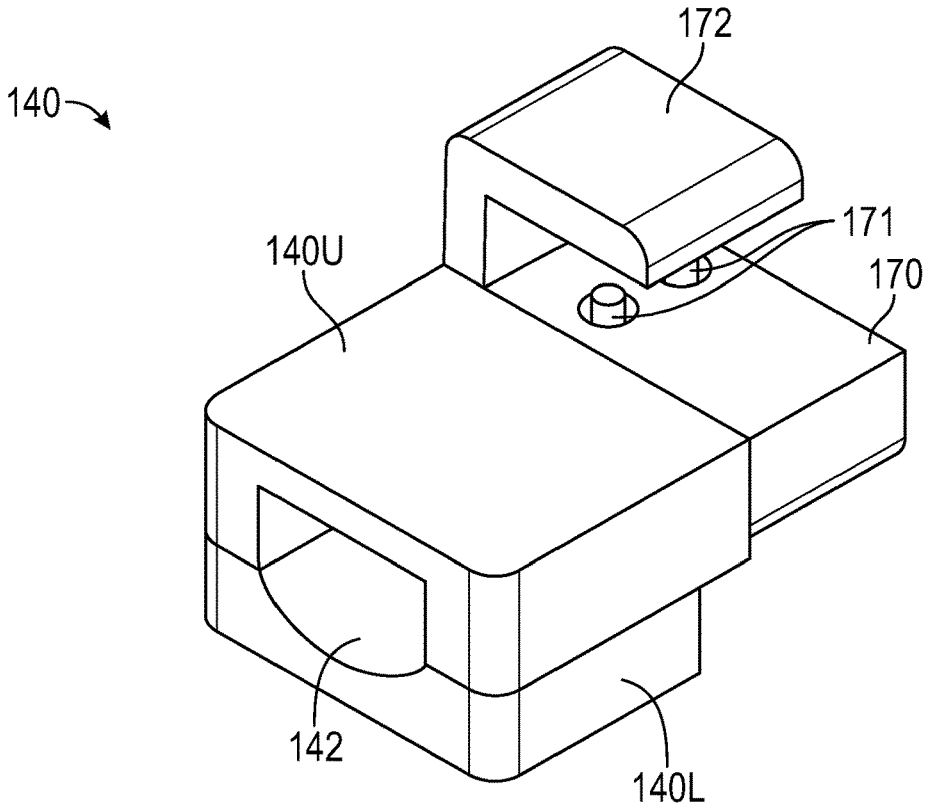

FIGS. 5B and 5C are detailed, top perspective views of the universal blind end block assembly 140 illustrated in FIG. 5A, with FIG. 5B depicted with a panel surface mounting block 160 attached thereto and FIG. 5C depicted with a panel edge mounting block 170 attached thereto. The illustrations of FIGS. 5B and 5C will be described simultaneously.

As previously described, the lower portion 140L mates with the upper portion 140U and is mechanically mated with a series of fasteners (not shown in the FIGS. 5B and 5C illustrations). When the lower portion 140L is mated to the upper portion 140U, a cavity 142 is defined. An LED light strip 130 may be terminated within the cavity 142.

The panel surface mounting block 160 includes a threaded mounting screw 161 and a washer 162, such as a rubber washer. The block 160 may be threaded in order to receive the threaded mounting screw 161, as would be understood by one of ordinary skill in the art. The threaded mounting screw 161 may be inserted through a hole drilled in a food shield panel (such as panel 105) and threaded into block 160 that is positioned beneath the panel. By contrast, the panel edge mounting block 170 includes a hook feature 172 configured to receive an edge of a panel (such as panel 105). One or more set screws 171 may be tightened from beneath in order to secure the block 170 to the panel edge.

Figure 6A:
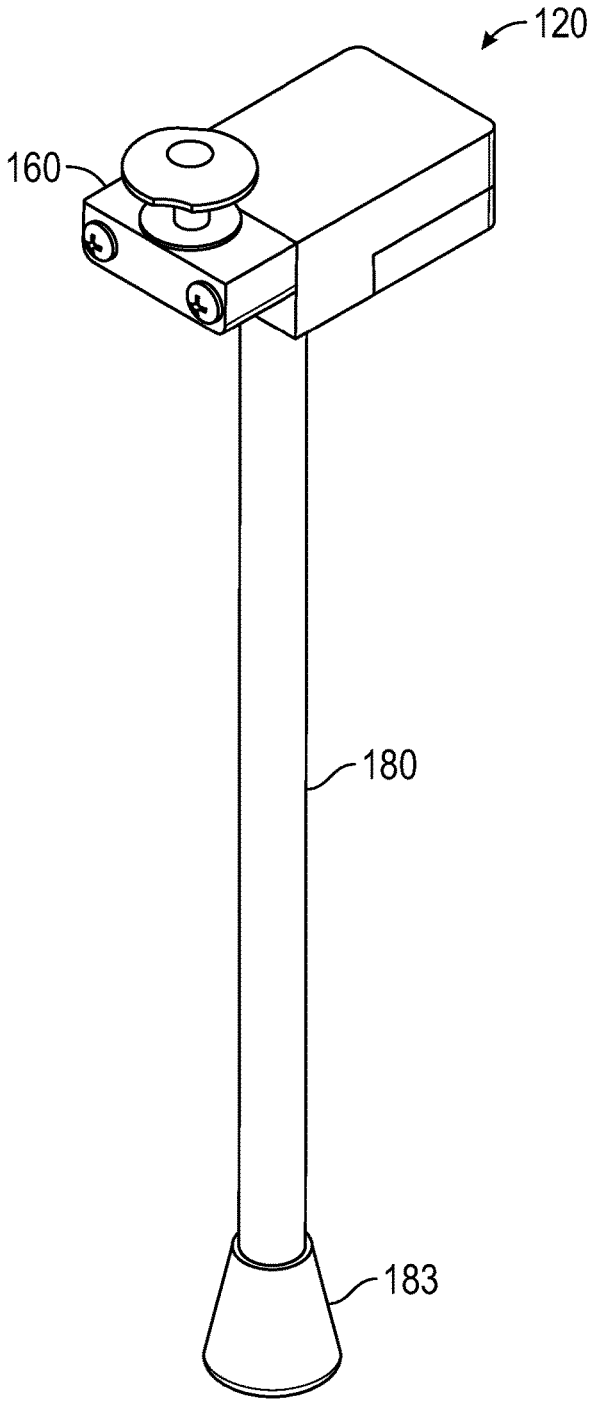
FIGS. 6A and 6B are detailed, top perspective views of a wire guide and counter collar assembly included in certain embodiments of the solution to transition wiring from a counter surface to a universal wiring end block assembly, with FIG. 6A showing a panel surface mounting block attached to the wiring end block assembly and FIG. 6B showing a panel edge mounting block attached to the wiring end block assembly.
Figure 6B:
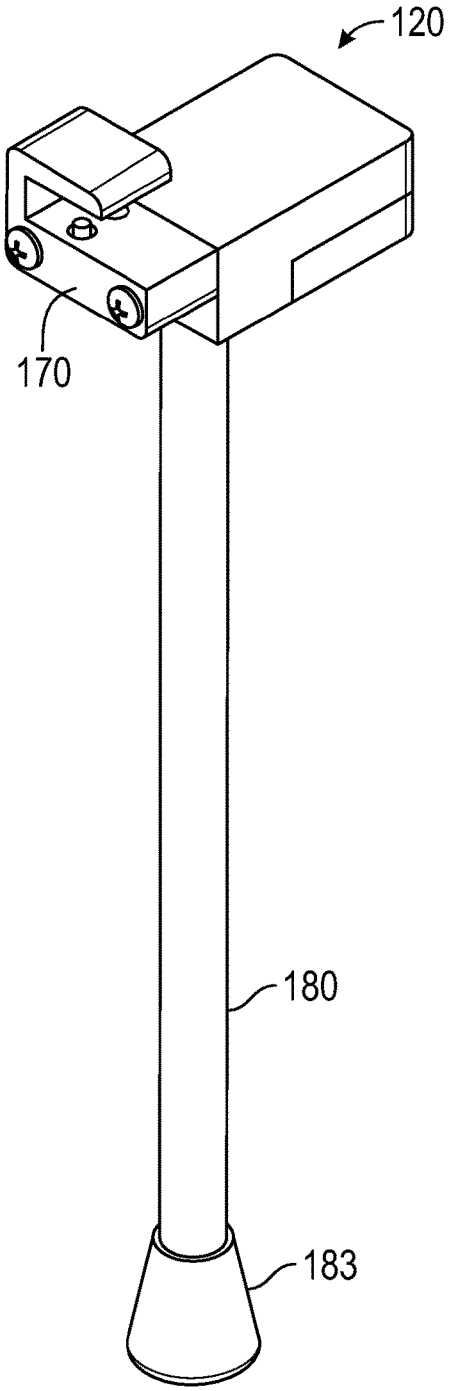

FIGS. 6A and 6B are detailed, top perspective views of a wire guide conduit 180 and counter collar 183 assembly included in certain embodiments of the solution to transition wiring from a counter surface to a universal wiring end block assembly 120, with FIG. 6A showing a panel surface mounting block 160 attached to the wiring end block assembly 120 and FIG. 6B showing a panel edge mounting block 170 attached to the wiring end block assembly 120.

Figure 6C:
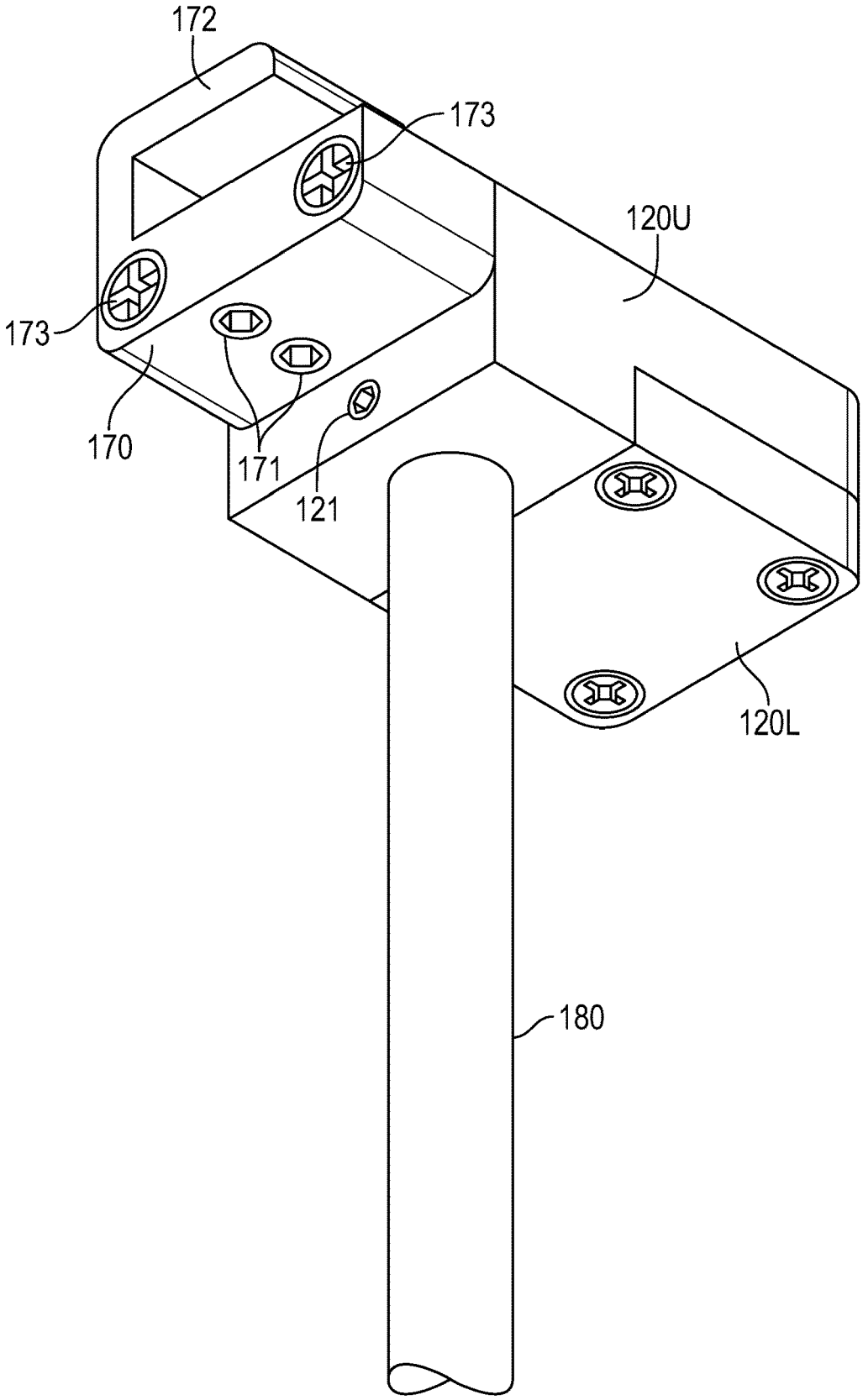
FIG. 6C is a detailed, bottom perspective view of the wiring end block assembly and wire guide shown in the FIG. 6B illustration.

FIG. 6C is a detailed, bottom perspective view of the universal wiring end block assembly 120 and wire guide conduit 180 shown in the FIG. 6B illustration. The conduit 180 may be received by the block assembly 120 and secured in place with a set screw 121. The panel edge mounting block 170 may be modularly mounted to the block assembly 120 via one or more threaded fasteners 173. Similarly, although not shown, a panel surface mounting block 160 may be alternatively modularly mounted to the block assembly 120 via the one or more threaded fasteners 173. Notably, a panel surface mounting block 160 or a panel edge mounting block 170 may be similarly mounted modularly to a blind end block assembly 140, as could be understood from a review of previous figures in view of at least this FIG. 6C illustration.

Figure 7A:
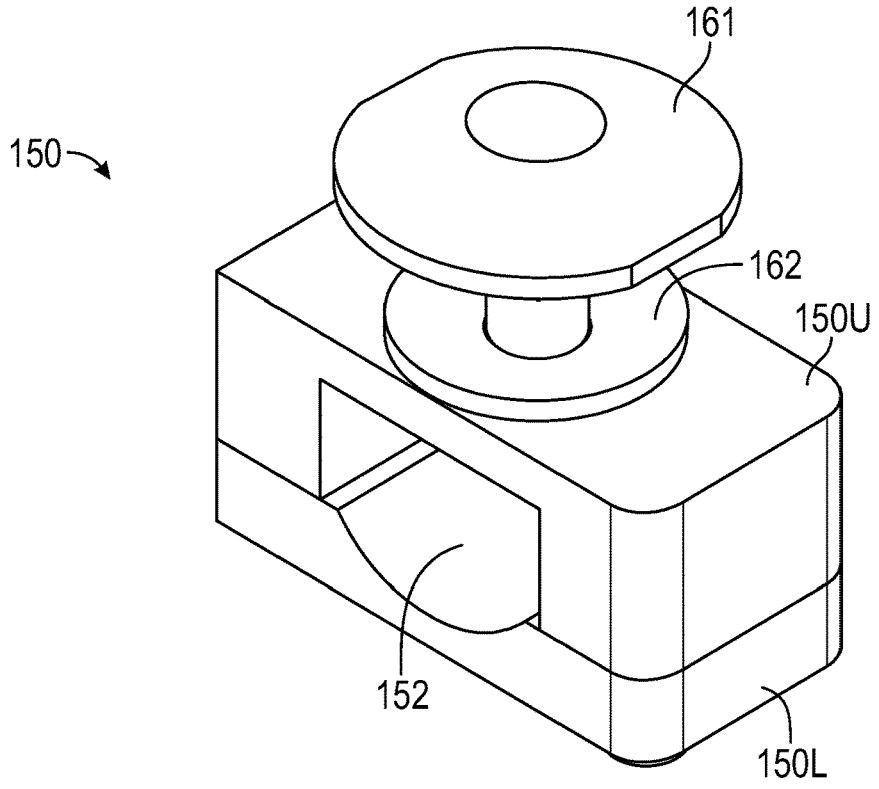
FIGS. 7A and 7B are detailed, top perspective views of center support blocks included in certain embodiments of the solution, with the center support block in FIG. 7A configured for panel surface mounting and the center support block in FIG. 7B configured for panel edge mounting.
Figure 7B:
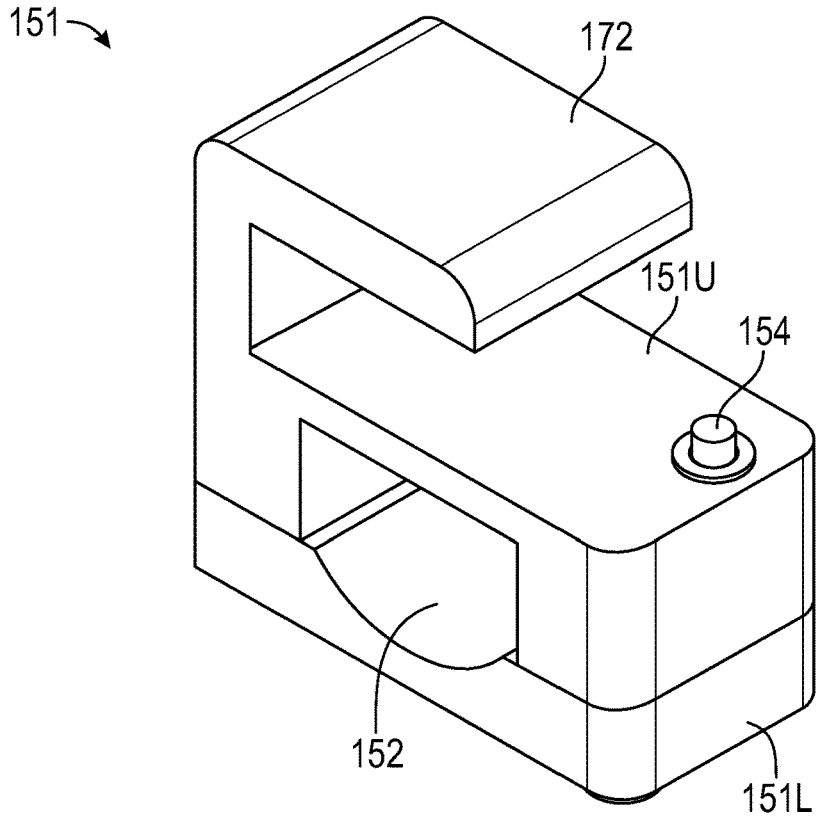

FIGS. 7A and 7B are detailed, top perspective views of center support blocks 150/151 included in certain embodiments of the solution, with the center support block 150 in FIG. 7A configured for panel surface mounting and the center support block 151 in FIG. 7B configured for panel edge mounting. The illustrations of FIGS. 7A and 7B will be described simultaneously.

As previously described, the lower portions 150L/151L mate with their respective upper portions 150U/151U and are mechanically secured with a series of fasteners (not shown in the FIGS. 7A and 7B illustrations). When the lower portions 150L/151L are mated to the upper portions 150U/151U, a cavity 152 is defined. An LED light strip 130 may be translated or extended through the cavity 152.

The center support block 150 includes a threaded mounting screw 161 and a washer 162, such as a rubber washer. The upper portion 150U of the center support block 150 may be threaded in order to receive the threaded mounting screw 161, as would be understood by one of ordinary skill in the art. The threaded mounting screw 161 may be inserted through a hole drilled in a food shield panel (such as panel 105) and threaded into upper portion 150U that is positioned beneath the panel. By contrast, the upper portion 151U of the center support block 151 includes a hook feature 172 configured to receive an edge of a panel (such as panel 105). One or more set screws 154 may be tightened from beneath in order to secure the block 151 to the panel edge.

Figure 7C:
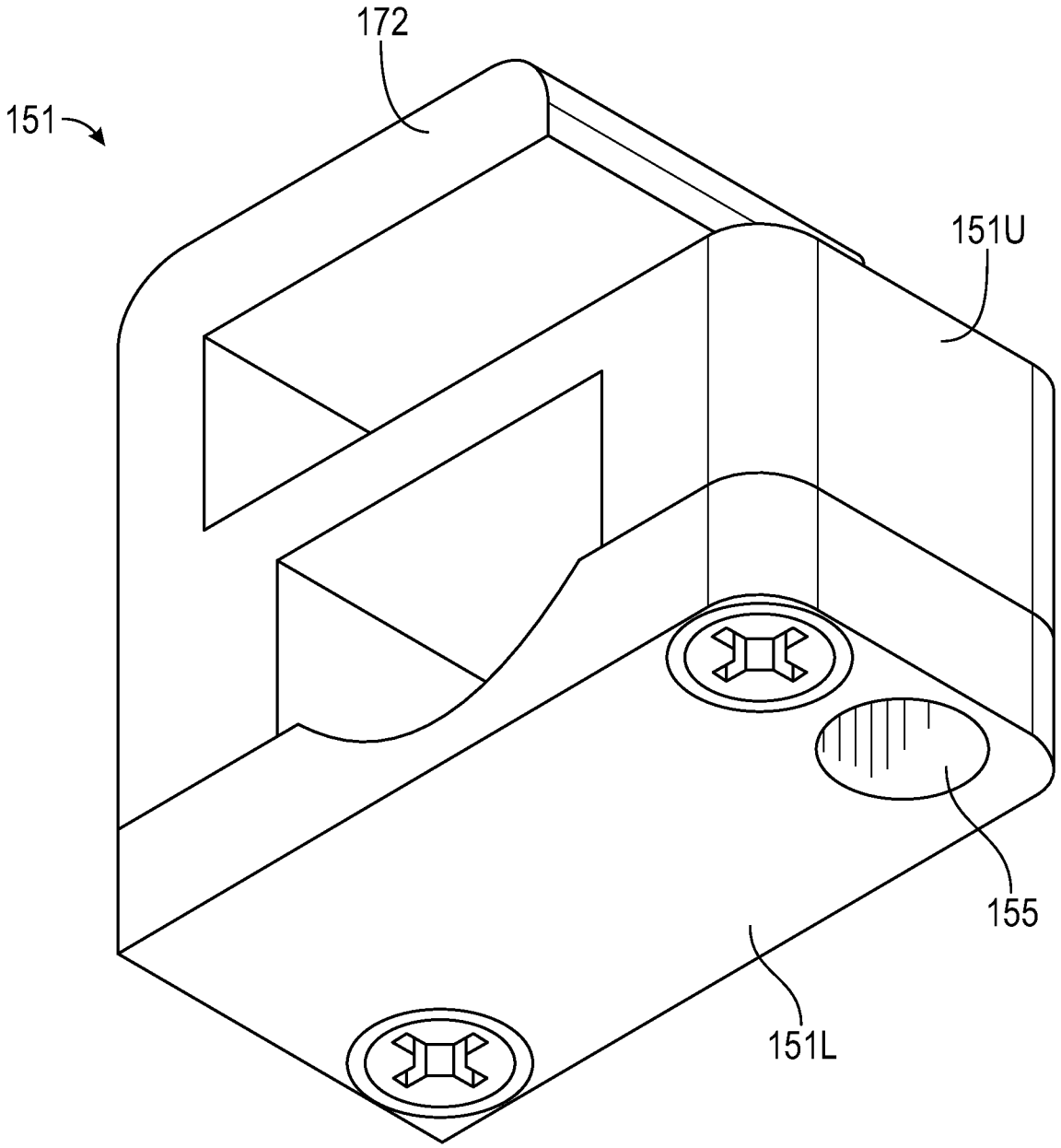
FIG. 7C is a detailed bottom perspective view of the center support block shown in the FIG. 7B illustration.

FIG. 7C is a detailed bottom perspective view of the center support block 151 shown in the FIG. 7B illustration. As can be understood from the FIG. 7C illustration when considered in view of the FIGS. 7A and 7B illustrations, a bore 155 through the lower portion 151L of the center support block 151 may provide access to set screw 154. In this way, when a panel edge is received into the hook feature 172, the set screw 154 may be tightened such that the panel edge is secured.

Figure 8A:
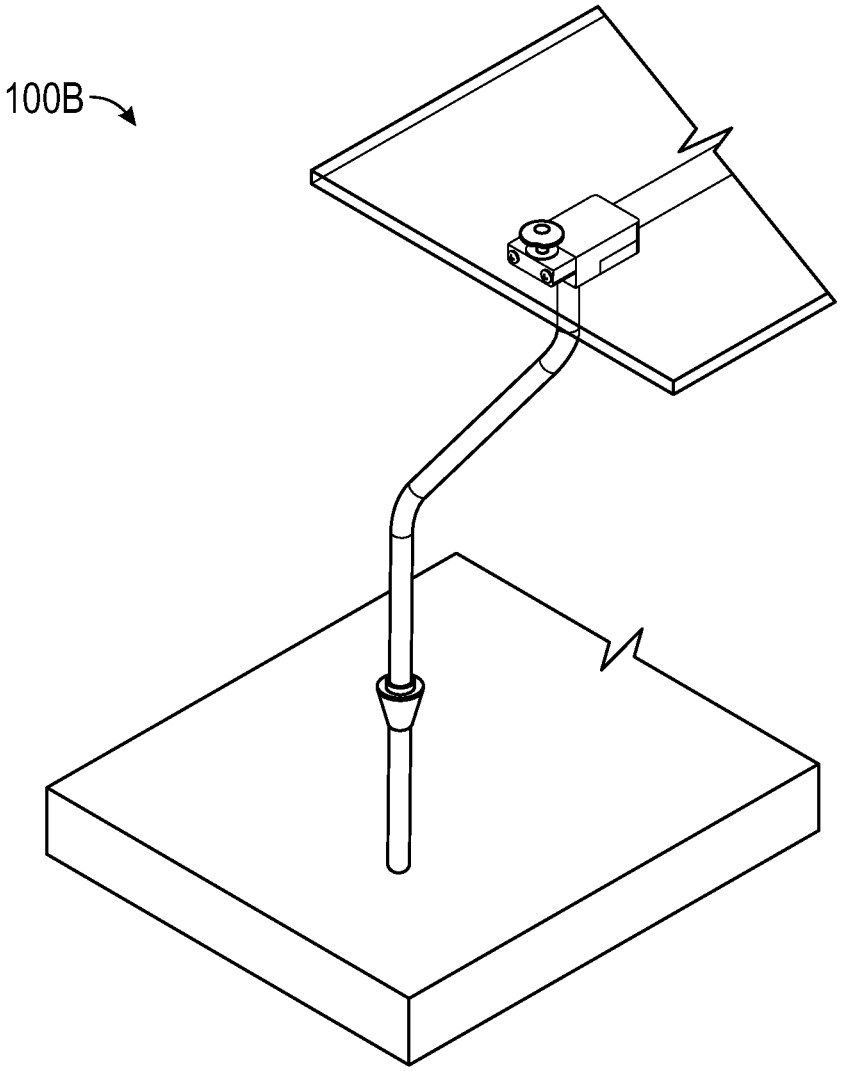
FIGS. 8A and 8B illustrate panel surface mounted and panel edge mounted embodiments of the solution, respectively, for a system for retrofit of an LED light kit to a food shield system, shown mounted to panels of a food shield and wired from a counter surface.
Figure 8B:
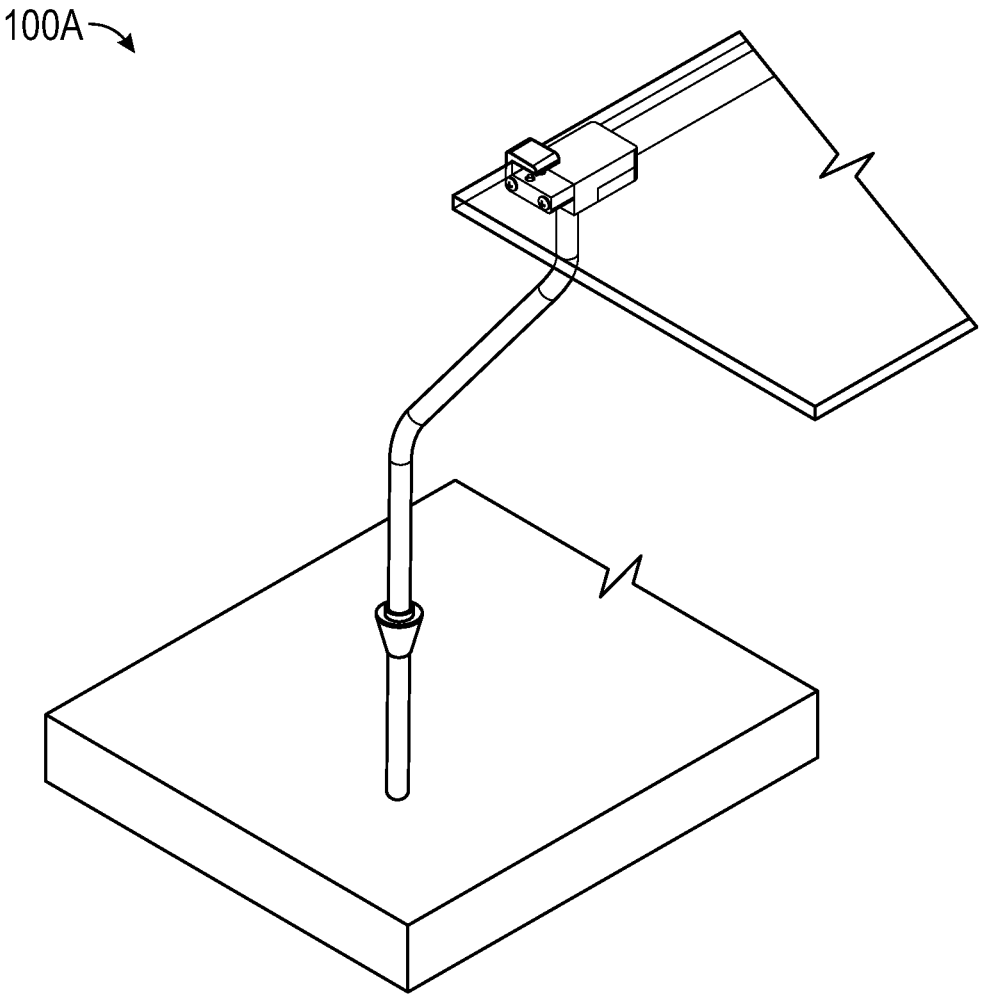

FIGS. 8A and 8B illustrate panel surface mounted 100A and panel edge mounted 100B embodiments of the solution, respectively, for a system for retrofit of an LED light kit to a food shield system, shown mounted to panels of a food shield and wired from a counter surface.

Systems and methods for a system for retrofit of an LED light kit to a food shield system have been described using detailed illustrations and descriptions of embodiments thereof that are provided by way of example and are not intended to limit the scope of the disclosure. The described and illustrated embodiments comprise different features, not all of which are required in all embodiments of the solution. Some embodiments of the solution utilize only some of the features or possible combinations of the features. Variations of embodiments of the solution that are described and embodiments of the solution comprising different combinations of features noted in the described embodiments will occur to persons of the art.

It will be appreciated by persons skilled in the art that a system or method for retrofit of an LED light kit to a food shield system according to the solution is not limited by what has been particularly shown and described herein above. Rather, the scope of the disclosed solution is defined by the claims that follow.

What is claimed is:

1. A system for retrofit of an LED light kit to a food shield system, the system comprising:

an LED light strip;

a wiring end block assembly comprised of an upper portion and a lower portion, wherein the upper portion and the lower portion are separable and mechanically mated by one or more fasteners and cooperate to define an internal cavity of the wiring end block assembly, the internal cavity of the wiring end block assembly being configured to receive a plug head associated with power supply wiring through a first aperture and a power connection head associated with the LED light strip through a second aperture; and a blind end block assembly comprised of an upper portion and a lower portion, wherein the upper portion and the lower portion are separable and mechanically mated by one or more fasteners and cooperate to define an internal cavity of the blind end block assembly, the internal cavity of the blind end block assembly being configured to receive an end head associated with the LED light strip through a first aperture.

2. The system of claim 1, wherein the internal cavity of the wiring end block assembly comprises one or more shoulders configured to seat against the plug head associated with power supply wiring such that the plug head is prevented from being retracted through the first aperture.

3. The system of claim 1, wherein the wiring end block assembly further comprises a separable mounting block operable to mechanically mate the system to a food shield panel.

4. The system of claim 3, wherein the separable mounting block further comprises a threaded screw.

5. The system of claim 3, wherein the separable mounting block further comprises a hook feature.

6. The system of claim 5, wherein the separable mounting block further comprises one or more set screws.

7. The system of claim 1, wherein the blind end block assembly further comprises a separable mounting block operable to mechanically mate the system to a food shield panel.

8. The system of claim 7, wherein the separable mounting block further comprises a threaded screw.

9. The system of claim 7, wherein the separable mounting block further comprises a hook feature.

10. The system of claim 9, wherein the separable block further comprises one or more set screws.

11. The system of claim 1, wherein the wiring end block assembly is configured to mechanically receive a wiring conduit.

12. The system of claim 11, further comprising a counter collar slidably mounted on the conduit.

13. The system of claim 1, further comprising one or more center support blocks, each of the one or more center support blocks comprised of an upper portion and a lower portion, wherein the upper portion and the lower portion are separable and mechanically mated by one or more fasteners and cooperate to define an internal cavity of the center support block through which the LED light strip may be inserted.

14. The system of claim 13, wherein the upper portion of each of the one or more center blocks comprises a threaded screw.

15. The system of claim 13, wherein the upper portion of each of the one or more center blocks comprises a hook feature.

16. The system of claim 15, wherein the lower portion of each of the one or more center blocks comprises an access bore for accessing a set screw in the upper portion.

17. The system of claim 1, wherein one or both of the wiring end block assembly and blind end block assembly are comprised of aluminum, stainless steel, or plastic.

* * * * *